United States Patent [19]

Irie

[11] 4,321,434

[45] Mar. 23, 1982

[54] ELECTROACOUSTIC TRANSDUCER

[75] Inventor: Hideyuki Irie, Yokohamashi, Japan

[73] Assignee: Tokyo Shibaura Denki Kabushiki Kaisha, Japan

[21] Appl. No.: 162,642

[22] Filed: Jun. 24, 1980

[30] Foreign Application Priority Data

Jul. 13, 1979 [JP] Japan ..... 54-088742

[51] Int. Cl.[3] ..... H04R 7/20

[52] U.S. Cl. ..... 179/181 R; 179/115.5 ES; 181/172

[58] Field of Search ..... 179/115.5 ES, 181 R; 181/172, 171

*Primary Examiner*—George G. Stellar
*Attorney, Agent, or Firm*—Finnegan, Henderson, Farabow, Garrett & Dunner

[57] ABSTRACT

An electroacoustic transducer having a diaphragm apparatus. The diaphragm apparatus has an annular diaphragm and a pair of outer and inner edges respectively conjoining with the outside and the inside of the diaphragm. Both edges have sets of pleats arranged continuously along the circumferential directions of the diaphragm but directed in opposite directions to each other. Each pleat, at least in the outer edge, comprises a bottom line extending from a boundary between the outer fixing area and the outer edge to a boundary between the outer edge and the diaphragm wherein an arc defined by the point of intersection of the inner end of the bottom line of any pleat in the outer edge and the second boundary and the point of tangency on the second boundary of a line through the point of intersection of the outer end of the same bottom line and the first boundary subtends a central single $\theta_0$ and the position of the former point of intersection is given by the relation;

$$\tan\theta_0 = \frac{\sqrt{\frac{R^2}{r^2}-1} - \sqrt{\frac{A^2}{a^2}-1}}{1+\sqrt{\left(\frac{R^2}{r^2}-1\right)\left(\frac{A^2}{a^2}-1\right)}}$$

where $\theta_0$ is the central angle subtending the arc, and R, r, A and a are the radii of the first boundary, the second boundary, a third boundary between the diaphragm and the inner edge and a fourth boundary between the inner edge and an inner fixing area conjoining with the inner edge.

9 Claims, 6 Drawing Figures

ELECTROACOUSTIC TRANSDUCER

FIELD OF THE INVENTION

This invention relates to electroacoustic transducers having an annular diaphragm and, more particularly, to electroacoustic transducers with edges that allow both an up-and-down movement of the annular diaphragm in a perpendicular direction and a to-and-fro movement about its center.

BACKGROUND OF THE INVENTION

The edge supporting the annular diaphragm in an electroacoustic transducer, for example as used in a loudspeaker or a microphone, has a great influence on the transducing characteristics of the diaphragm for example, the response or distortion characteristics.

Ideal conditions essentially required for an edge for supporting an electroacoustic diaphragm are as follows:

a. The edge should have an excellently high compliance with respect to the axial movement of the diaphragm.

b. The edge should have a good stiffness with respect to the lateral movement of the diaphragm.

c. The edge should have a good linearity in the vibration of the large amplitudes.

d. The edge should be light in weight so as not to obstruct the free movement of the diaphragm.

SUMMARY OF THE INVENTION

It is, therefore, an object of the present invention to provide an electroacoustic transducer which has an excellent response characteristics and can work with a low distortion in sound.

Another object of the present invention is to provide an electroacoustic transducer having edges which do not give rise to an undesirable resonance and can follow a movement of the associated diaphragm.

A further object of the present invention is to provide edges for the diaphragm which have a high compliance with respect to the movement of the diaphragm in the axial direction of the electroacoustic transducer.

Still another object of the present invention is to provide edges for the diaphragm which do not have a bad influence on the diaphragm.

A further object of the present invention is to provide a novel means for suspending the annular diaphragm of an electroacoustic transducer.

The diaphragm apparatus, according to the present invention, is characterized by the fact that the diaphragm apparatus has an outer edge including pleats, each bottom line of which extends from a first boundary adjacent an outer fixing ring to a second boundary adjacent to conjoining annular diaphragm under the condition that the radius of the annular diaphragm defined by the intersection of any bottom line with second boundary lies between a radius defined by the intersection of that bottom line with the first boundary and the radius defined the point of tangency of the tangent through the latter intersection, whereby the outer edge is pliable to follow the movement of the diaphragm in company with an inner edge conjoining the diaphragm, the inner edge also including pleats.

The above and other objects, features and advantages of the present invention will be apparent from the following description taken in connection with the accompanying drawings, in which:

DETAILED DESCRIPTION

Figure 1:
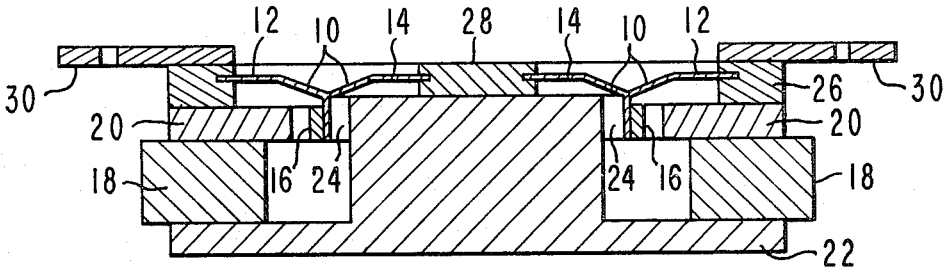
FIG. 1 PRIOR ART
FIG. 1 shows a longitudinal sectional view of a typical loudspeaker which has an annular diaphragm apparatus.

The present invention will be described in detail with reference to the accompanying drawings. Throughout the drawings, like reference numerals will be used to designate like or equivalent portions, for simplicity of explanation.

The prior art to which this invention is an improvement includes Japanese Utility Model Application No. 136126/78 laid open to public inspection. The prior art deals with an annular diaphragm similar to this invention.

FIG. 1 shows a longitudinal sectional view of a typical structure of an electroacoustic transducer of the prior art which has an annular diaphragm apparatus. The structure shown in FIG. 1 comprises a diaphragm 10, an inner edge 14, supporting an inner peripheral portion of the diaphragm 10, a voice coil 16 driving the diaphragm 10, a permanent magnet 18 producing a magnetic field, a pole plate 20 secured on one side of the magnet 18, a center pole 22, secured on the other side of the magnet 18 and leaving an air-gap 24 between the center pole 22 and the pole plate 20 in order to give the magnetic field to the voice coil 16, an outer supporting member 26 fixing the outer edge 12, an inner supporting member 28 fixing the inner edge 14, and a frame 30 in order to fit the whole to a baffle.

Figure 2:
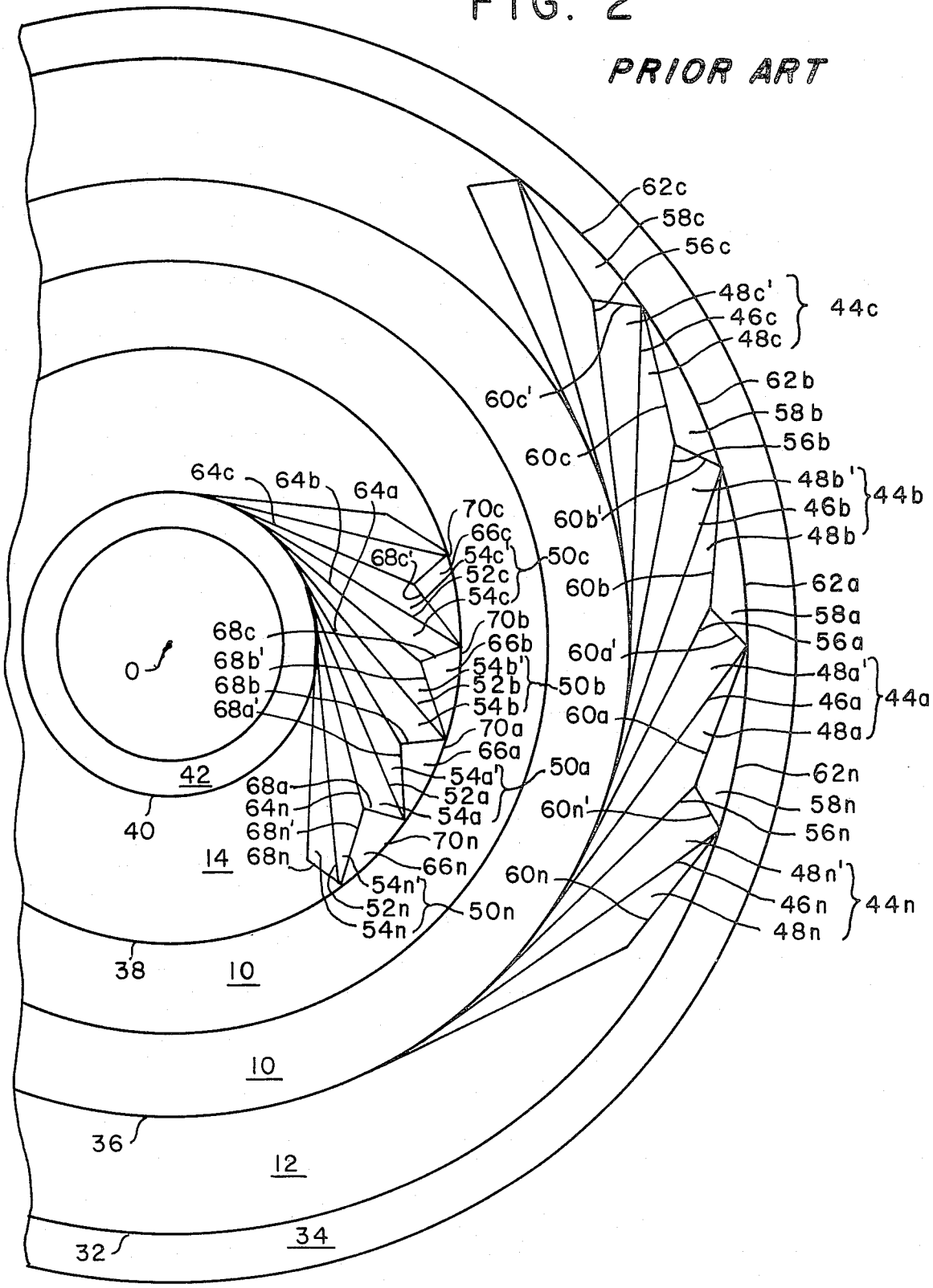
FIG. 2 PRIOR ART
FIG. 2 shows a plan view of a diaphragm of the prior art.

An annular diaphragm apparatus in the above-described prior art is structured as shown in FIG. 2. The outer and inner edges 12 and 14 are respectively constituted by a large number of pleats and plates. The outer edge 12 has first and second circular boundary lines, the first 32 between an outer fixing area 34 and the outer edge 12, and the second 36 between the diaphragm 10 and the outer edge 12. The inner edge 14 has third and fourth circular boundary lines, the third 38 between the diaphragm 10 and the inner edge 14, and the fourth 40 between an inner fixing area 42 and the inner edge 14.

The pleats 44*a*, 44*b*, . . . 44*n* in the outer edge 12 have respectively bottom lines 46*a*, 46*b*, . . . 46*n* and two faces 48*a* and 48*a*′ 48*b* and 48*b*′, . . . 48*n* and 48*n*′, the faces lying respectively on each side of the bottom lines and diverging outwardly from the bottom lines. The pleats 50*a*, . . . 50*n* in the inner edge 14 also have respectively bottom lines 52*a*, 52*b*, . . . 52*n* and two faces 54*a* and 54*a*′, 54*b* and 54*b*′, . . . 54*n* and 54*n*′, and faces lying respectively on each side of the bottom lines and diverging outwardly therefrom. The pleats 44*a*, 44*b*, . . . 44*n* in the outer edge 12 and 50*a*, 50*b* . . . 50*n* in the inner edge 14 are continuously arranged along circumferential direction of the diaphragm 10, but the pleats 44*a*, 44*b* . . . 44*n* in the outer edge 12 and the pleats 50*a*, 50*b*, . . . 50*n* in the inner edge 14 are directed in opposite directions to each other.

The bottom lines 46*a*, 46*b*, . . . 46*n* of the pleats 44*a*, 44*b*, . . . 44*n*, extend from the first boundary line 32 clockwise to the second boundary line 36 and are tangential to the line 36. The bottom lines 52*a*, 52*b*, . . . 52*n* of the pleats 50*a*, 50*b*, . . . 50*n* extend from the third boundary line 38 counterclockwise to the fourth boundary line 40 and are tangential to the line 40. Adjacent pleats 44*a* and 44*b*, 44*b* and 44*c* . . . 44*n* and 44*a* adjoin each other at top lines 56*a*, 56*b* . . . 56*n*. Quasi-triangular plates 58*a*, 58*b*, . . . 58*n* adjacent to the outer fixing area 34 are formed by the outer lines 60*a*', 60*b*' . . . 60*n*' of faces 48*a*', 48*b*' . . . 48*n*', the outer lines 60*b*, 60*c* . . . 60*a* of faces 48*b*, 48*c* . . . 48*a* and arc portions 62*a*, 62*b*, . . . 62*n* each intercepting the first boundary line 32. Similarly, the adjacent pleats 50*a* and 50*b*, 50*b* and 50*c* . . . 50*n* and 50*a* adjoin each other at top lines 64*a*, 64*b* . . . 64*n*. Quasi-triangular plates 66*a*, 66*b* . . . 66*n* adjacent to the diaphragm 10 are formed by the outer lines 68*a*', 68*b*', . . . 68*n*' of faces 54*a*', 54*b*', . . . 54*n*', the outer lines 68*b*, 68*c* . . . 68*a* of faces 54*b*, 54*c*, . . . 54*a* and arc portions 70*a*, 70*b*, . . . 70*n* formed by the interception with the third boundary lines 38. Although the bottom and top lines forming the sides of the faces do not meet at precisely the same point of tangency of the boundary lines, the faces are stated to bitriangular for ease of description.

As a result, each face of a pleat is completed in substantially a triangle by an outer line joining the bottom line and top lines of the face. Two zigzag circumferential lines are formed by interconnecting the outer lines of the faces, one having points in common with the first boundary line 32 and the second having points in common with the third boundary line 38. The arcs 62, 62*b*, . . . 62*n* and 70*a*, 70*b*, . . . 70*n* intercepted on the boundary lines 32 and 38 form sides of the quasi-triangular plates 62*a*, 62*b*, . . . 62*n* and 66*a*, 66*b*, . . . 66*n*, the other two sides of each quasi-triangular plate being formed by the outer lines of faces of adjoining pleats. These quasi-triangular plates 62*a*, 62*b*, . . . 62*n* and 66*a*, 66*b*, . . . 62*n* are referred to hereinafter as plates.

The operation of the transducer of the prior art which has the diaphragm apparatus shown in FIG. 2 will be discussed to see whether the edges satisfy the various conditions described above. The diaphragm should perform a perfect longitudinal motion in the axial direction of the voice coil. Actually the diaphragm is subjected to a complex movement when an AC input signal is applied to a speaker as shown in FIG. 1. According to the longitudinal motion of the diaphragm 10, the edges 12, 14 follow the diaphragm's movement by means of swing motions of the bottom lines 46*a*, 46*b*, . . . 46*n* in the outer edge 12 and bottom lines 52*a*, 52*b*, . . . 52*n* in the inner edge 14 while pivoting on the ends of the bottom lines on the first and fourth boundary lines 32, 40 like a cantilever. The two faces of each pleat 48*a* and 48*a*', 48*b* and 48*b*', . . . 48*n* and 48*n*' in the outer edge 12 and 54*a* and 54*a*', 54*b* and 54*b*' . . . 54*n* and 54*n*' in the inner edge 14 concurrently move in butterfly-like motions. Thereupon, each pleat, especially each bottom line in the outer and inner edges 12, 14, works to suspend the diaphragm 10, and the butterfly motion of the two faces of each pleat makes it easy for each bottom line to swing. As a result, the diaphragm 10 tends to spin or move to-and-fro about the axis 0 of the diaphragm 10 in a small angle with the longitudinal motion of the diaphragm. The spin motion generally makes it easy for the diaphragm 10 to move and gives good compliance characteristics to the diaphragm 10.

However, the prior art has the important drawback that the operations of the outer and inner edges 12, 14, cannot match each other, as a result of which the diaphragm apparatus is not able to have sufficient compliance. The phenomenon will now be explained in detail by using FIG. 3 in which the diaphragm apparatus of prior art is diagrammatically shown on the X-Y co-ordinates.

Figure 3:
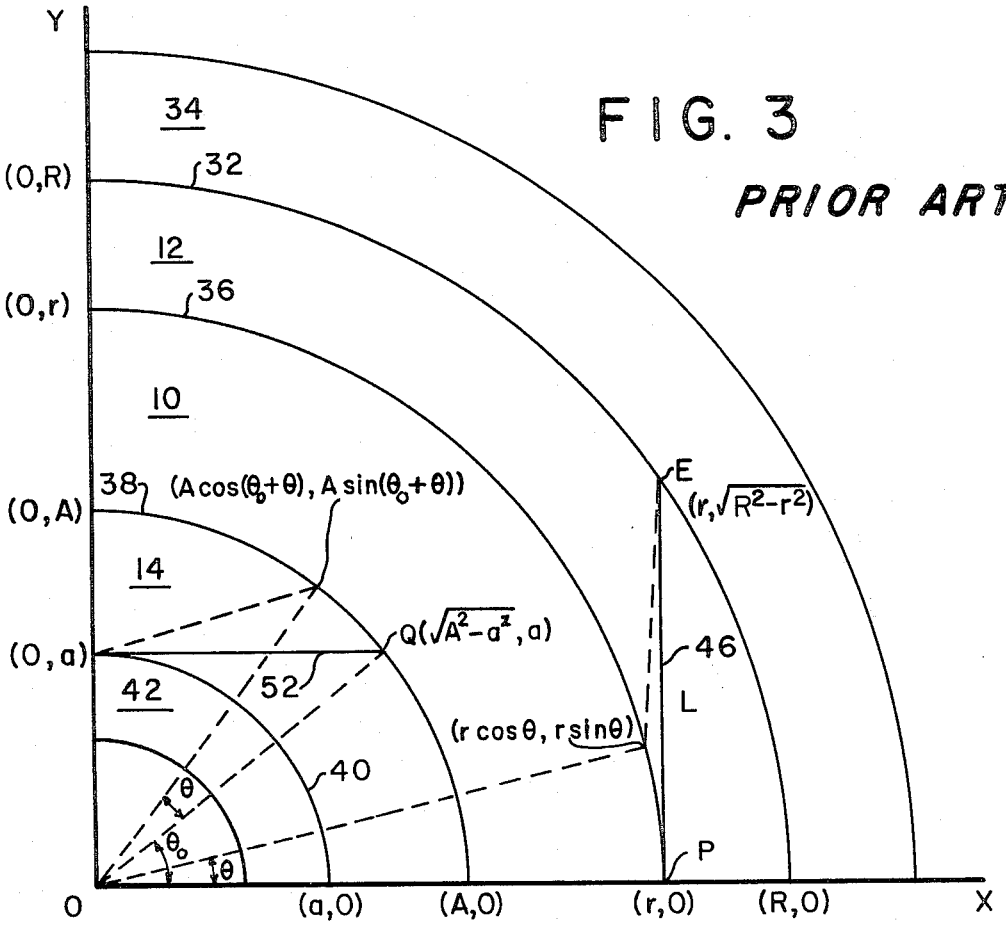
FIG. 3 PRIOR ART
FIG. 3 shows a partial diagrammatic view of the diaphragm of FIG. 2 on the X-Y co-ordinates.

In FIG. 3, two bottom lines 46, 52, are shown as representatives of respective bottom lines in the outer and inner edges 12, 14. For the sake of convenience of explanation, the bottom line 46 in the outer edge 12 is placed in parallel with the Y-axis, while the bottom line 52 is placed in parallel with the X-axis. The radii of the first, second, third and fourth boundary lines 32, 36, 38 and 40, are respectively represented by R, r, A and a. As a result, the length L and 1 of the bottom lines 46 and 52 respectively become $\sqrt{R^2-r^2}$, and $\sqrt{A^2-a^2}$, because the bottom lines 46, 52, are tangents which touch the second and fourth boundary lines 36, 40.

Now, when the diaphragm 10 spins at the small angle $\theta$, according to its axial movement, a point P where one end of the bottom line 46 touches the second boundary line 36 moves from its original co-ordinates (r,o) to the co-ordinates (r cos $\theta$, r sin $\theta$) because the point P lies on the outer side of the diaphragm 10. Similarly a point Q where the one end of the bottom line 52 touches the third boundary line 38 moves from its original co-ordinates ($\sqrt{A^2-a^2}$, a) to other co-ordinates (A cos ($\theta_0+\theta$), A sin ($\theta_0+\theta$), where $\theta_0$ is an angle between the line QO and the X-axis. Then vertical moving distances ($D_p$), ($D_Q$) of the points P, Q are respectively represented as follows $$D_p^2 = 2r^2\left(\sqrt{\frac{R^2}{r^2} - 1}\ \sin\theta + \cos\theta - 1\right)$$

$$D_Q^2 = 2a^2\left(\sqrt{\frac{A^2}{a^2} - 1}\ \sin\theta + \cos\theta - 1\right)$$

Since it is required that the diaphragm 10 moves uniformly in the axial direction at all portions of the diaphragm, it is always necessary that $D_p$ equals $D_Q$. But, from the above equations, the condition $D_p=D_Q$ cannot be obtained exception when the condition R=A and r=a are satisfied. The condition R=A and r=a is actually impossible to realize. Otherwise, in order to obtain a condition: $P_p=D_Q$ the relation :A/a>>R/r must be taken. But it is very difficult to realize this relation in the actual products since the relation A/a>R/a requires a large width of the inner edge 14 compared with that of the outer edge 12. Accordingly, the spin angles of the points P, Q. that is, an outer portion and an inner portion of the diaphragm 10 actually become different. As a result, a distortion arises in the diaphragm 10 or in the outer and inner edges 12, 14. Moreover, when the diaphragm 10 is attempting to move in a axial direction, each of the outer and inner edges 12, 14, tends to obstruct the movement of the other, or the diaphragm 10 cannot move uniformly in an axial direction since the axial movement distances $D_p$, $D_Q$ of the outer and inner portions of the diaphragm 10 tend to be different.

Therefore, the diaphragm apparatus of prior art gives rise to a result which is objectionable for the satisfactory performance of the speaker.

Further, if the inner edge 14 would be made to have a very much larger width than the outer edge 12 in order to obtain the above-described condition $D_p=D_Q$, the movement of the inner edge 14 gives rise to an undesirable peak-valley phenomenon in the response characteristics of the speaker since the inner edge 14 occupies a considerable portion of the radiation area of the speaker as viewed from the front side of the speaker. Also, the diaphragm 10 makes sorts of divisional vibrations since the diaphragm 10 cannot move uniformly in an axial direction.

Thus, the edges of the diaphragm in the prior art have various defects which prevent its proper action for use in an electroacoustic transducer.

Figure 4:
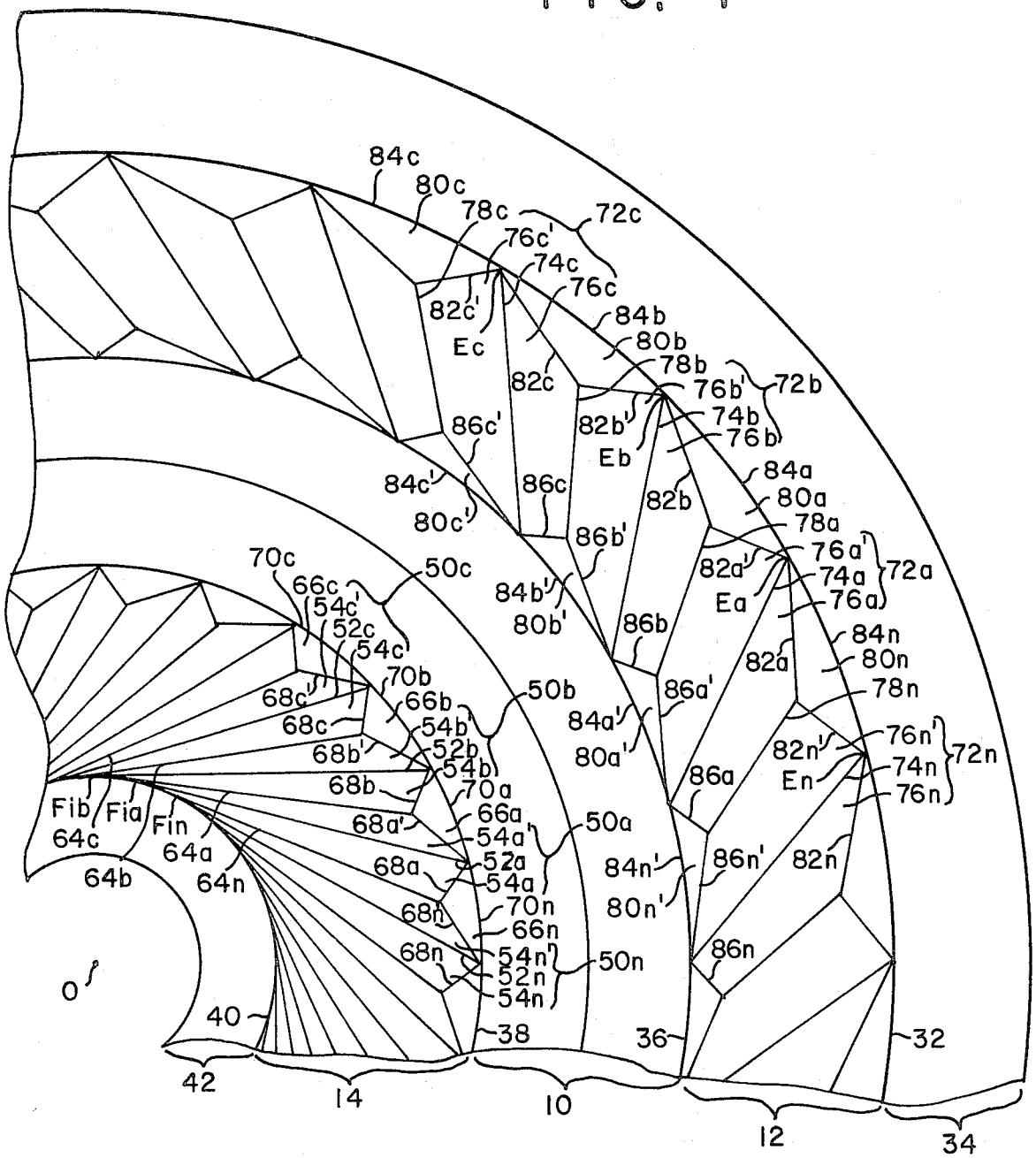
FIG. 4 shows a partially cutaway plan view of a preferred embodiment of the diaphragm in the present invention.

FIG. 4 shows a preferred embodiment of an annular diaphragm apparatus of the invention having certain elements in common with the prior art. The diaphragm apparatus of FIG. 4 is provided with a diaphragm 10 driven by a voice coil 16 or any conventional driving means, an improved outer edge 12 and an inner edge 14 each being adjacent the diaphragm 10, an outer fixing area 34 and an inner fixing area 42 being respectively adjacent the outer edge 12 and the inner edge 14 in order to fix the diaphragm in apparatus to the outer supporting member 26 and the inner supporting member 28. A first boundary 32 is formed between the outer fixing area 34 and the outer edge 12; a second boundary 36 is formed between the outer edge 12 and the diaphragm 10; a third boundary 38 is formed between the diaphragm 10 and the inner edge 14; and a fourth boundary 40 is formed between the inner edge 14 and the inner fixing area 42.

Both the outer and inner edges 12, 14 are constituted by a large number of pleats and plates, and the four boundaries 32, 36, 38, 40 are shaped in the form of narrow grooves.

The structure of the diaphragm apparatus of the invention will be described in more detail with reference to FIG. 4 and FIG. 5. The diaphragm 10 has a conventional V-like sectional shape in which the center is depressed to form the bottom of V (shown in FIG. 1). On the bottom is attached the voice coil 16. The outer edge 12 has a set of pleats and two sets of plates, while the inner edge 14 has a set of pleats and a set of plates.

The pleats 72*a*, 72*b* . . . 72*n* in the outer edge 12 have respectively bottom lines 74*a*, 74*b* . . . 74*n* and two faces 76*a* and 76*a'*, 76*b* and 76*b'*, . . . 76*n* and 76*n'*, the faces lying respectively on each side of the bottom lines and diverging outwardly from the bottom line. The pleats 50*a*, 50*b* . . . 50*n* in the inner edge 14 are formed in the same manner and bear the same relationship to the third and fourth boundaries 38, 40 as explained previously, as to the prior art.

The pleats 72*a*, 72*b* . . . 72*n* in the outer edge 12 are continuously arranged along a circumferential direction of the diaphragm 10, but are directed clockwise or in opposite direction to the pleats 50*a*, 50*b* . . . 50*n* in the inner edge 14. That is, the bottom lines 74*a*, 74*b* . . . 74*n* of the pleats 72*a*, 72*b* . . . 72*n* in the outer edge 12, extend from the first boundary 32 clockwise to the second boundary 36. An arc is defined by the point of intersection of the inner end of the bottom line of any pleat in the outer edge 12 and the boundary line 36 and the point of tangency on the boundary line 36 of a line through the point of intersection of the outer end of the same bottom line and the boundary line 32. This intercepted arc subtends a central angle $\theta_0$, shown on FIG. 5 as related to the four boundary lines and will be defined hereinafter.

Adjacent pleats 72*a* and 72*b*, 72*b* and 72*c* . . . 72*n* and 72*a* in the outer edge 12 adjoin each other at top lines 78*a*, 78*b* . . . 78*n*. The first set of quasi-triangular plates 80*a*, 80*b* . . . 80*n* in the outer edge 12 adjacent the outer fixing area 34 are formed by the outer lines 82*a'*, 82*b'* . . . 82*n'* of the faces 76*a'*, 76*b'* . . . 76*n'*, the outer lines 82*b*, 82*c* . . . 82*a* of the faces 76*b*, 76*c* . . . 76*a* and arc portions 84*a*, 84*a*, 84*b* . . . 84*n* each intercepted on the first boundary 32. The second set of quasi-triangular plates 80*a'*, 80*b'* . . . 80*n'* in the outer edge 12 adjacent the diaphragm 10 are formed by the inner lines 86*a'*, 86*b'* . . . 86*n'* of faces 76*a'*, 76*b'* . . . 76*n'*, the inner lines 86*b*, 86*c* . . . 86*a* of the faces 76*b*, 76*c*, . . . 76*a* and arc portions 84*a'*, 84*b'* . . . 84*n'* each intercepted on the second boundary 36. Each top line in the outer edge 12 has the same general direction as the adjacent bottom lines in the outer edge 12, but is not parallel thereto. As a result, each face in the outer edge 12 is a trapezium formed by the bottom and top lines and the outer and inner lines. Consequently, three zigzag circumferential lines are formed, (1) by the interconnections of the outer lines of the trapezium faces, i.e., the outer lines having points in common with the first boundary 32, (2) the interconnecting inner lines of the trapezium faces, i.e., the inner lines having points in common with the second boundary 34, and (3) the interconnecting outer lines of the triangular faces of the inner edge, i.e., the lines having points in common with the third boundary 38, the third zigzag line being formed in the same manner as explained previously, as to the prior art.

By virtue of the provision of a different kind of the pleat in the outer edge from that of the prior art, the outer and inner edges 12, 14 can easily expand and contract in the circumferential directions of the diaphragm 10. Accordingly, when the diaphragm 10 is moved in a direction along the axis of the voice coil 16, the outer and inner edges 12, 14, can allow the axial movement of the diaphragm 10 by means of swing motions of the pleats. The bottom lines 74*a*, 74*b* . . . 74*n* of the pleats 72*a*, 72*b* . . . 72*n* in the outer edge 12 swing on respective ends Ea, Eb . . . En, as centers, on the first boundary line 32, and the bottom lines 52*a*, 52*b* . . . 52*n* of the pleats 50*a*, 50*b* . . . 50*n*, on the inner edge 14 swing on their respective ends Fia, Fib . . . Fin as centers on the fourth boundary line 40.

In addition, the adjacent faces 76*a* and 76*a'*, 76*b* 76*b'* . . . 76*n* and 76*n'* of the pleats 72*a*, 72*b* . . . 72*n* in the outer edge 12 and the adjacent faces 54*a* and 54*a'*, 54*b* and 54*b'* . . . 54*n* and 54*n'* of the pleats 50*a*, 50*b* . . . 50*n* on the inner edge 14 accomplish butterfly-like motions. So, the diaphragm 10 turns or moves to-and-fro about the axis O of the diaphragm 10, in a small angle by means of the swing motions of the outer and inner edges 12, 14. However, the turn motion of the diaphragm 10 has no bad effect on the sound reproduction because the turn motion is always co-axial with the diaphragm 10.

The interrelated movements of the diaphragm 10 and the outer an inner edges 12, 14, will be described in more detail with respect to FIG. 5. FIG. 5 is the diagrammatical view of the diaphragm apparatus of FIG. 4 on the X-Y co-ordinates in section, in which two bottom lines 74 and 52 are shown as representatives of respective bottom lines in the outer and inner edges 12, 14. For the sake of convenience of explanation, the bottom line 52 in the inner edge 14 is placed in parallel with the X-axis, while the bottom line 74 in the outer edge 12 is placed under the condition that the tangent 88 of the second boundary 36 terminating at the same point E on the first boundary 32 with the bottom line 74 is placed in parallel with the Y-axis. Further, the inner end G of the bottom line 74 and the outer end H of the bottom line 52 on the second and third boundaries 36, 38, respectively, are placed on the same radius, for the same reason. It should be noted that the points G and H do not necessarily lie on the same radius.

Radii of the first, second, third and fourth boundary lines 32, 36, 38 and 40, are respectively represented by R and r, A and a, and the co-ordinates of the ends E, G, of the bottom line 74 and the ends H, F of the bottom line 52, are represented respectively, by $(r, \sqrt{R^2-r^2})$, $(r \cos \theta_0, r \sin \theta_0)$, $(\sqrt{A^2-a^2}, a)$ and $(o,a)$, where $\theta_0$ is an angle between line GO or HO and the X-axis.

Now, when the diaphragm 10 turns by an angle $\theta$ according to its axial movement, the ends G and H respectively move from their original co-ordinates to other co-ordinates $(r \cos (\theta+\theta_O), r \sin (\theta+\theta_0))$ and $(A \cos (\theta+\theta_0), A \sin (\theta+\theta_0))$. Then vertical moving distances $D_G$ and $D_H$ of the ends G, H are respectively represented as follows:

$$D_H^2 = 2r^2\left[\sqrt{\frac{R^2}{r^2}-1}\ \{\sin(\theta+\theta_0)-\sin\theta_0\} + \cos(\theta+\theta_0)-\cos\theta_0\right] \quad (1)$$

$$D_H^2 = 2a^2\left[\sqrt{\frac{A^2}{a^2}-1}\cdot\sin\theta+\cos\theta-1\right] \quad (2)$$

These equations (1) and (2) may be changed to the following equations (3) and (4), $$D_G^2 = 2r^2\left[\sqrt{M}\cdot(\sin\theta\cos\theta_0+\cos\theta\sin\theta_0-\sin\theta_0) + \cos\theta\cos\theta_0-\sin\theta\sin\theta_0-\cos\theta_0\right] \quad (3)$$

$$D_H^2 = 2a^2\left[\sqrt{m}\cdot\sin\theta+\cos\theta-1\right] \quad (4)$$

where $M = \frac{R^2}{r^2}-1$ and $m = \frac{A^2}{a^2}-1$.

In above equations (3), (4), the condition requested for achieving a smooth movement of the diaphragm 10 or the edges 12, 14, is obtained by letter $D_G$ equal $D_H$. Accordingly, the following equations (5), (6) are induced from the equations (3) and (4):

$$r^2\sqrt{M}\sin\theta_0+r^2\cdot\cos\theta_0-a^2=0 \quad (5)$$

$$r^2\sqrt{M}\cos\theta_0-r^2\cdot\sin\theta_0-a^2\sqrt{m}=0 \quad (6)$$

The equation (5) can be change to the following equation (7):

$$a^2=r^2\sqrt{M}\cdot\sin\theta_0+r^2\cos\theta_0 \quad (7)$$

And, by substituting the equation (7) into the equation (6) the following equation (8) is obtained:

$$\sqrt{M}\cdot\cos\theta_0-\sin\theta_0-\sqrt{M\cdot m}\sin\theta_0-\sqrt{m}\cdot\cos\theta_O=0 \quad (8)$$

Accordingly, as a result, the following relation (9) achieved from the above equation (8) has to be satisfied.

$$\tan\theta_0 = \frac{\sqrt{M}-\sqrt{m}}{1+\sqrt{M\cdot m}} = \frac{\sqrt{\frac{R^2}{r^2}-1}-\sqrt{\frac{A^2}{a^2}-1}}{1+\sqrt{\left(\frac{R^2}{r^2}-1\right)\left(\frac{A^2}{a^2}-1\right)}} \quad (9)$$

From the relation (9) it is easily understood that the diaphragm 10 can be smoothly driven when both sets of the bottom lines 74*a*, 74*b* . . . 74*n* on the outer edge 12 and the bottom lines 74*a*, 74*b* . . . 74*n* on the outer edge 12 and the bottom lines 52*a*, 52*b* . . . 52*n* on the inner edge 14 are designed in accordance to the relation (9).

Figure 5:
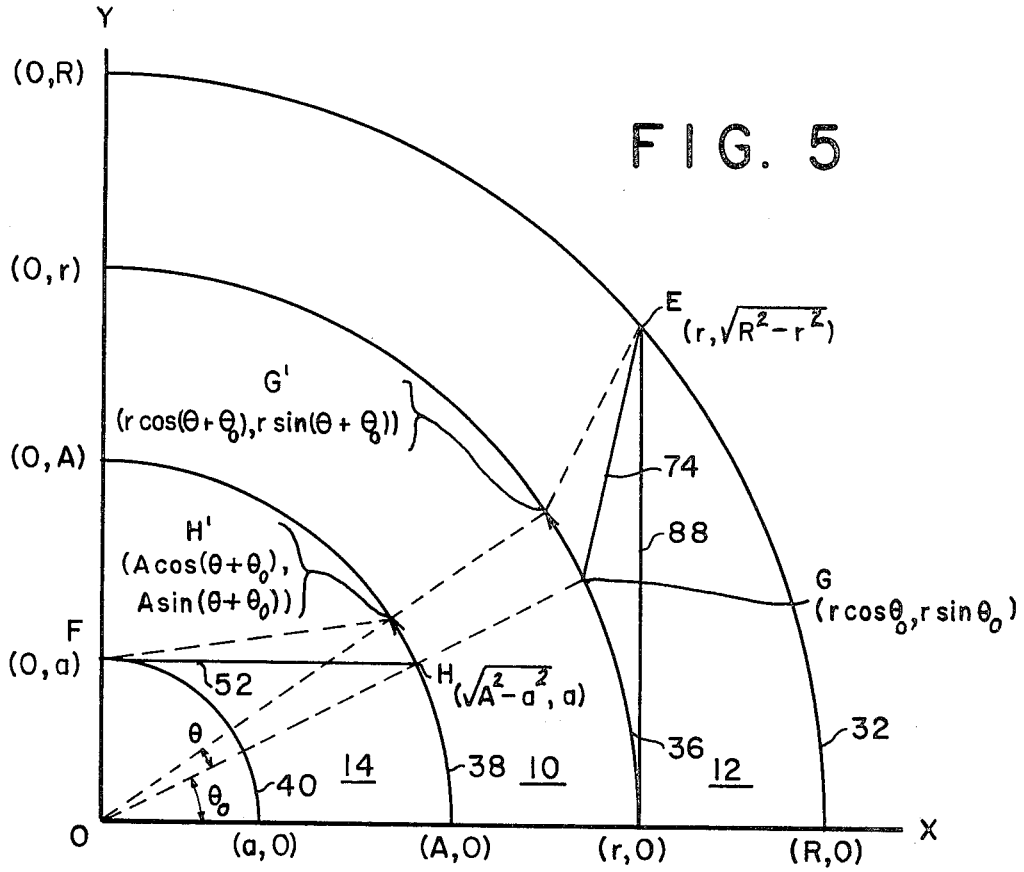
FIG. 5 shows a partial, diagrammatic view of the diaphragm of FIG. 4 on the X-Y co-ordinates.

As is understood from FIG. 5, the angle $\theta_0$ represents the proper central angle subtended by the arc defined by the point of intersection of the inner end of the bottom line in the outer edge and the second boundary 36 and the point of tangency of the tangent through the point of intersection of the outer end of the same bottom line and the first boundary 32.

It is better that the top lines 78*a*, 78*b* . . . 78*n* in the outer edge 12 be calculated by the same method by projecting these lines to intersect the boundary lines 32, 36 but the control angles so subtended need not be precisely the same as those subtended for the bottom lines, since both ends of the top lines are free from the first and second boundary lines 32, 36. The top lines 78*a*, 78*b* . . . 78*n* work to make the swing motion of the bottom lines 74*a*, 74*b* . . . 74*n* of the faces 76*a*, 76*a'*, 76*b* . . . 76*n'* and the first and second quasi-triangular plates 80*a*, 80*b* . . . 80*n*, and 80*a'*, 80*b'*. . . 80*n'*.

The top lines 64*a*, 64*b* . . . 64*n* in the inner edge 14 need not be precisely tangent to the fourth boundary line 40 for the same reason as given for the control angles of the top lines 78*a*, 78*b* . . . 78*n*.

Likewise, it is possible to make the inner ends of the top lines 64*a*, 64*b* . . . 64*n* in the inner edge 14 free from the fourth boundary line 40 by means of forming a set of quasi-triangular plates along the fourth boundary line 40 similar to the set of quasi-triangular plates 80*a'*, 80*b'* . . . 80*n'* along the second boundary line 48.

On the other hand, the inner ends of the top lines 78*a*, 78*b* . . . 78*n* of the outer edge 12 may be placed on the second boundary line 36, thus eliminating the set of plates contiguous with the second boundary line.

Now, an example which the inventor made in accordance with this invention will be described. In this example, the diaphragm apparatus is made by titanium plate with thickness of 30 μm. The radii of the first, second, third, and fourth boundaries are respectively 29.9 mm, 24.35 mm, 15.2 mm and 9.5 mm. Then, the intercepted angle $\theta_0$ is designed to about 18.3″ by using the relation of equation (9).

The following table shows results of a test for comparing the example (A) of the invention with a diaphragm apparatus (B) equivalent to the example except the latter (B) being formed by the prescribed old technique.

| | Reasonable Frequency (fo) | 3rd harmonics noise ratio at (fo) frequency |
|---|---|---|
| B | 1,500 [Hz] | 1 (%) |
| A | 1,300 [Hz] | 0.3 (%) |

As is evident from the above table, the diaphragm apparatus (A) according to this invention is very superior to the diaphragm apparatus (B) according to prior art at its resonance frequency characteristics and its third harmonic suppression characteristics.

Figure 6:
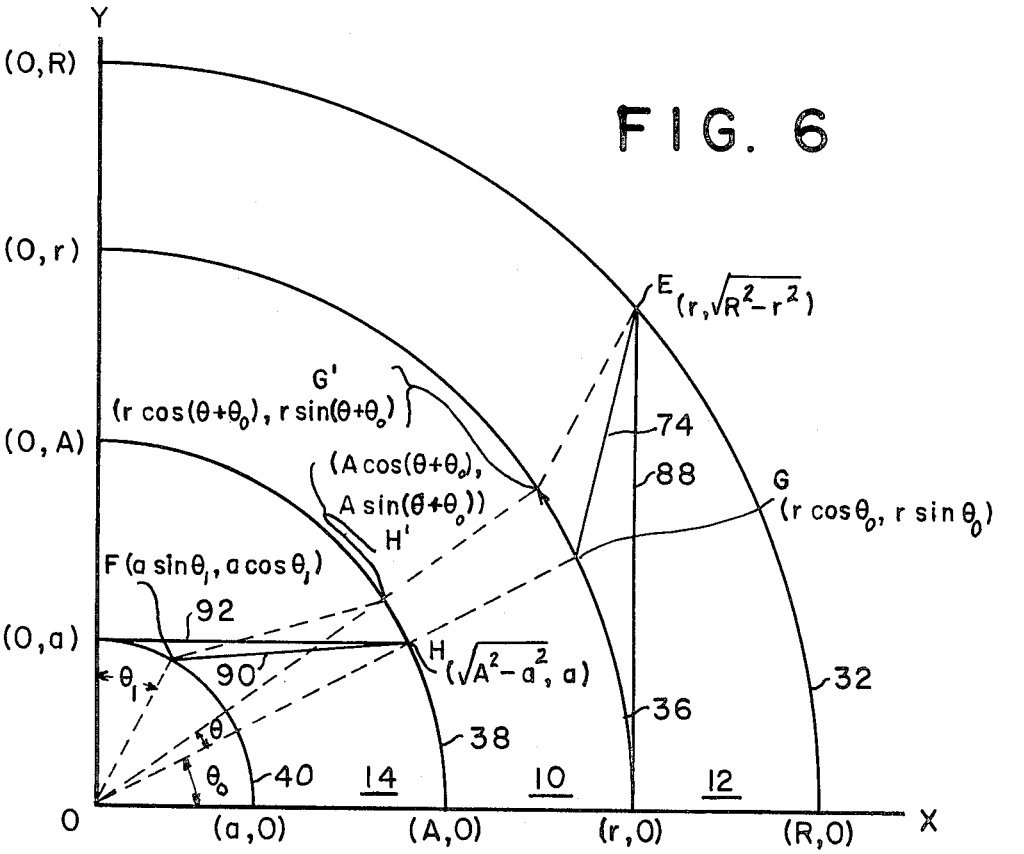
FIG. 6 shows a partially diagrammatic view of another preferred embodiment of the diaphragm of the present invention on the X-Y co-ordinates.

FIG. 6 shows a diagrammatical view of another embodiment according to this invention on the X-Y co-ordinates. In this embodiment, the inner edge 14 also has plates each extending from the third boundary 38 counterclockwise to the fourth boundary 40. In this embodiment of inner ends of the bottom lines of the inner edges intercept the fourth boundary line 40. The positioning of these bottom lines is determined by a method similar to the positioning of the bottom lines of the outer edge in the first embodiment and the control angles subtended as to the bottom lines of the outer and inner edges are intersected.

In this case, the central angle $\theta_0$ subtended by an arc on the second boundary line 36, as to the bottom lines of the outer edges as in the first embodiment, is determined not only by the radii of the first, second, third and fourth boundary lines, but also by the control angle subtended by an arc of the fourth boundary line intercepted by the inner ends of the bottom lines falling in the fourth boundary line. The lines 74 and 90 in FIG. 6 are shown as representatives of respective bottom lines in the outer and inner edges 12 and 14. For the sake of convenience of explanation, the bottom line 90 is so placed that the tangent 92 on the fourth boundary 40, terminating at the same point H (as defined in the first embodiment) on the third boundary 38 with the bottom line 90 is placed in parallel with the X-axis. The diagram as to the bottom line of the outer edge is like FIG. 5 and the lines have the same reference numerals. Radii of the first, second, third and fourth boundary lines 32, 36, 38, 40, are respectively represented by R, r, A and a, and the co-ordinates of the ends E, G of the bottom line 74 and the ends F, H of the bottom line 90 are represented, respectively, by $(r, \sqrt{R^2=r^2})$ $(r\cos\theta_0, r\sin\theta_0)$, $(\sqrt{A^2-a^2}, a)$ and $(a\sin\theta_1, a\cos\theta_1)$ where $\theta_0$ is an angle between line GO and HO and the X-axis, $\theta_1$ is an angle between line HO and the Y-axis.

Now, when the diaphragm 10 turns by an angle $\theta$ according to its axial movement, the ends G and H, respectively, move from their original co-ordinates to other co-ordinates ($r\cos(\theta+\theta_0)$, $r\sin(\theta+\theta_0)$ and $A\cos(\theta+\theta_0)$, $A\sin(\theta+\theta_0)$). Then, the vertical moving distances $D_G$ and $D_H$ of the ends G, H, are respectively represented as follows:

$$D_G^2 = 2r^2\sqrt{M}\cdot(\sin(\theta+\theta_0)-\sin\theta_0)+\cos(\theta+\theta_0)-\cos\theta_0 \tag{10}$$

$$D_H^2 = 2a^2\left[\frac{A}{a}\sin(\theta+\theta_1)-\sqrt{m}\cdot\sin\theta_1-\cos\theta_1\right] \tag{11}$$

These equations (10), (11) may be changed as following equations (12), (13):

$$D_G^2 = 2r^2\left[\sqrt{M}(\sin\theta\cos\theta_0+\cos\theta\sin\theta_0-\sin\theta_0)+\cos\theta\cos\theta_0-\sin\theta\,c\sin\theta_0-\cos\theta_0\right] \tag{13}$$

$$D_H^2 = 2a^2\left[\frac{A}{a}\{\sin\theta\cdot\cos(\theta_0+\theta_1)+\cos\theta\cdot\sin(\theta_0+\theta_1)\}=\sqrt{M}\cdot\sin\theta_1-\cos\theta_1\right] \tag{14}$$

In above equations (13), (14), the condition requested for achieving a smooth movement of the diaphragm 10 or the edges 12, 14, is obtained by letting $D_G$ equal $D_H$. Accordingly, the following equations (15), (16) are induced from the equations (13), (14).

$$r^2\sqrt{M}\sin\theta_0+r^2\cos\theta_0-a\,A\sin(\theta_0+\theta_1)=0 \tag{15}$$

$$r^2\sqrt{M}\cos\theta_0-r^2\sin\theta_0-a\,A\cos(\theta_0+\theta_1)=0 \tag{16}$$

The values of aA sin $(\theta_0\theta_1)$ and aA cos $(\theta_0+\theta_1)$ are developed as follows:

$$a\,A\sin(\theta_0+\theta_1)=A\sin\theta_0\cdot a\cos\theta_1+A\cos\theta_0\cdot a\sin\theta_1=a\cdot a\cos\theta_1+\sqrt{A^2-a^2}\cdot a\sin\theta_1 \tag{17}$$

$$a\,A\cos(\theta_0+\theta_1)=A\cos\theta_0\cdot a\cos\theta_1-A\sin\theta_0\cdot a\sin\theta_1=\sqrt{A^2-a^2}\cdot a\cos\theta_1-a\cdot a\sin\theta_1 \tag{18}$$

Accordingly, the equations (15) and (16) can be rewritten as follows:

$$r\sqrt{R^2-r^2}\sin\theta_0+r^2\cos\theta_0-a^2\cos\theta_1-a\sqrt{A^2-a^2}\sin\theta_1=0 \tag{19}$$

$$r\sqrt{R^2-a^2}\cos\theta_0-r^2\sin\theta_0+a^2\sin\theta_1-a\sqrt{A^2-a^2}\cos\theta_0=0 \tag{20}$$

The equation (19) can be further rewritten as follows:

$$a^2\cos\theta_1=r\sqrt{R^2-r^2}\sin\theta_0+r^2\cos\theta_0-a\sqrt{A^2-a^2}\sin\theta_1 \tag{21}$$

Then by substituting the equation (21) into the equation (20), the following equation (22) is obtained:

$$r\sqrt{R^2-r^2}\cos\theta_0-r^2\sin\theta_0+a^2\sin\theta_1-\sqrt{m}\left(r\sqrt{R^2-r^2}\sin\theta_0+r^2\cos\theta_0-a\sqrt{A^2-a^2}\sin\theta_1\right)=r^2\left(\sqrt{M}-\sqrt{m}\right)\cos\theta_0-r^2\left(1+\sqrt{M\cdot m}\right)\sin\theta_0+a^2(1+m)\sin\theta_1=0 \tag{22}$$

By the way $$a^2(1+m)=a^2+a^2\left(\frac{A^2}{a^2}-1\right)=a^2+A^2-a^2=A^2$$

So, the equation (22) may be rewritten as follows:

$$r^2(\sqrt{M}-\sqrt{m})\cos\theta_0-r^2(1+\sqrt{M\cdot m})\sin\theta_0+A^2\sin\theta_1=0$$

Accordingly, the following equation is obtained:

$$\sin\theta_1 = \frac{r^2}{A^2}\left\{\left(1+\sqrt{M\cdot m}\right)\sin\theta_0 - \left(\sqrt{M}-\sqrt{m}\right)\cos\theta_0\right\} = \frac{r^2}{A^2}\left[\left\{1+\sqrt{\left(\frac{R^2}{r^2}-1\right)\left(\frac{A^2}{a^2}-1\right)}\right\}\sin\theta_0 - \left(\sqrt{\frac{R^2}{r^2}-1}-\sqrt{\frac{A^2}{a^2}-1}\right)\cos\theta_0\right] \quad (23)$$

From the relation (23), it is easily understood that the angle $\theta_1$ is given by fixing the angle $\theta_0$ and respective radii R, r, A, and a, of the boundaries 32, 36, 38 and 40 in accordance with equation (23).

What is claimed is:

1. An electroacoustic transducer comprising:

an annular diaphragm;

an outer edge and an inner edge each respectively adjacent the outside and the inside of the diaphragm for suspending the diaphragm;

an outer fixing area adjacent the outside of the outer edge for fixing the diaphragm to an outer supporting member;

an inner fixing area adjacent the inside of the inner edge for fixing the diaphragm to an inner supporting member; first and second sets of pleats arranged continuously along the circumferential directions of the outer and inner edges of the diaphragm, but directed in opposite directions to each other, each pleat in the outer edge including a bottom line extending from a first boundary between the outer fixing area and the outer edge to a second boundary between the outer edge and the diaphragm; wherein the point of intersection of each bottom line in the outer edge with the first boundary determines a tangent to the second boundary and wherein a radius of an annular diaphragm passing through the intersection of any bottom line with the second boundary lies between a radius passing through the intersection of that bottom line with first boundary and a radius through the point of tangency.

2. An electroacoustic transducer according to claim 1 wherein: each said pleat in the inner edge includes a bottom line extending from a third boundary between the diaphragm and the inner edge to a fourth boundary between the inner edge and the inner fixing area wherein the bottom line is a tangent of the fourth boundary.

3. An electroacoustic transducer according to claim 2, wherein each said bottom line in the outer edge is positioned substantially by the relation:

$$\tan\theta_0 = \frac{\sqrt{\frac{R^2}{r^2}-1}-\sqrt{\frac{A^2}{a^2}-1}}{1+\sqrt{\left(\frac{R^2}{r^2}-1\right)\left(\frac{A^2}{a^2}-1\right)}}$$

subtended by the arc defined by the point of intersection of the inner end of the bottom line in the outer edge and the second boundary and the point of tangency of the tangent through the point of intersection of the outer end of the same bottom line and the first boundary, and R, r, A and a are the radii of the first, second, third and fourth boundaries.

4. An electroacoustic transducer according to claim 1, wherein each pleat in the inner edge comprises a bottom line extending from a third boundary between the diaphragm and the inner edge to a fourth boundary between the inner edge and the inner fixing area wherein the point of intersection of each bottom line in the inner edge with the third boundary determines a tangent to the fourth boundary and wherein a radius of the diaphragm passing through the intersection of any bottom line in the inner edge with the fourth boundary lies between a radius passing through the intersection of the bottom line with the third boundary and a radius through the point of tangency of the tangent through the point of intersection of the outer end of the same bottom line an the third boundary.

5. An electroacoustic transducer according to claim 4, wherein each said bottom line in the outer edge and each said bottom line in the inner edge run in respective directions represented by the relation:

$$\sin\theta_1 = \frac{r^2}{A^2}\left\{\left(1+\sqrt{\left(\frac{R^2}{r^2}-1\right)\cdot\left(\frac{A^2}{a^2}-1\right)}\cdot\sin\theta_0 - \sqrt{\frac{A^2}{r^2}-1}-\sqrt{\frac{A^2}{a^2}-1}\right)\cos\theta_0\right\}$$

where $\theta_1$ is the central angle subtended by the arc defined by the point of intersection of the inner end of the bottom line in the inner edge and the fourth boundary and the point of tangency of the tangent through the point of intersection of the outer end of the same bottom line and the third boundary, $\theta_0$ is the central angle subtended by the arc defined by the point of intersection of the inner end of the bottom line in the outer edge and the second boundary and the point of tangency of the tangent through the point of intersection of the outer end of the same bottom line and the first boundary, and R, r, A and a are the radii of the first, second, third and fourth boundaries.

6. An electroacoustic transducer according to claims 2, 3, 4 or 5, wherein each top line between two adjacent pleats in the outer edge is free from the first and second boundaries.

7. An electroacoustic transducer according to claims 2, 3, 4 or 5 wherein each top line between two adjacent pleats in the outer edge is extended to the second boundary.

8. An electroacoustic transducer according to claims 2, 3, 4 or 5, wherein each top line between two adjacent pleats in the inner edge is free from the third and fourth boundaries.

9. An electroacoustic transducer according to claims 2, 3, 4 or 5, wherein each top line between two adjacent pleats in the inner edge is extended to the fourth boundary.

* * * * *